US012495938B1

(12) United States Patent
Bassett

(10) Patent No.: US 12,495,938 B1
(45) Date of Patent: Dec. 16, 2025

(54) TOE CLEANING DEVICE

(71) Applicant: Michael Bassett, Leroy, MI (US)

(72) Inventor: Michael Bassett, Leroy, MI (US)

( * ) Notice: Subject to any disclaimer, the term of this patent is extended or adjusted under 35 U.S.C. 154(b) by 418 days.

(21) Appl. No.: 18/091,466

(22) Filed: Dec. 30, 2022

(51) Int. Cl.

| | |
|---|---|
| ***A47K 7/02*** | (2006.01) |
| ***A46B 9/02*** | (2006.01) |
| ***A46B 15/00*** | (2006.01) |
| ***A46D 1/00*** | (2006.01) |
| *A45D 44/16* | (2006.01) |
| *A47L 23/22* | (2006.01) |

(52) U.S. Cl.
CPC ..... *A47K 7/026* (2013.01); *A46B 9/028* (2013.01); *A46B 15/0097* (2013.01); *A46D 1/0238* (2013.01); *A45D 44/16* (2013.01); *A46B 2200/1006* (2013.01); *A47L 23/22* (2013.01)

(58) Field of Classification Search
CPC ..... A46B 11/002; A46B 9/028; A47L 7/04; A47L 23/22; A47K 5/18
USPC ..... 15/160, 186, 188, 187
See application file for complete search history.

(56) References Cited

U.S. PATENT DOCUMENTS 2,210,365 A * 8/1940 Gilpin ..... A47L 23/22 15/112
4,730,949 A * 3/1988 Wilson ..... A46B 11/001 604/3
5,163,200 A * 11/1992 Carlin ..... A47K 7/026 222/206
5,177,829 A * 1/1993 Simpson ..... A47K 7/03 401/6
5,520,618 A * 5/1996 Massiet ..... A61H 7/002 132/74.5
5,724,695 A * 3/1998 Galizia ..... A46B 11/00 15/160
5,729,858 A * 3/1998 Riffel ..... A46B 9/02 4/606
5,813,078 A * 9/1998 Hogan, Sr. ..... A47K 7/026 4/606
5,983,433 A * 11/1999 Chapman ..... A46B 11/002 4/606
6,253,407 B1 * 7/2001 Bjelkevig ..... A47K 7/026 4/606
6,389,631 B1 * 5/2002 Keith ..... A47K 7/026 15/160
6,405,400 B1 * 6/2002 McClain ..... A47K 7/026 4/606
6,662,398 B1 * 12/2003 Thomson ..... A47K 7/03 4/606
6,740,052 B1 5/2004 Regner
7,219,387 B1 * 5/2007 Moore ..... A47K 3/022 4/606
7,260,863 B2 * 8/2007 Kaufman ..... A61B 90/70 15/244.4
7,500,282 B1 * 3/2009 Park ..... A47K 7/02 4/606

(Continued)

*Primary Examiner* — Michael D Jennings
(74) *Attorney, Agent, or Firm* — Cramer Patent & Design, PLLC.; Aaron R. Cramer

(57) ABSTRACT

A toe cleaning device is a conical shaped scrubbing device having an abrasive material secured on the outer surface of the conical shape. The underside surface of the device has a suction cup capable of being removably secured to a bathtub or shower surface. The device is intended to permit a user to clean between the user's toes in a hands-free manner.

1 Claim, 4 Drawing Sheets

(56) References Cited

U.S. PATENT DOCUMENTS

| | | | | |
|---|---|---|---|---|
| 7,578,021 | B1 * | 8/2009 | Figueroa | A47K 7/024 4/606 |
| 8,555,430 | B2 | 10/2013 | Nicas | |
| D694,415 | S | 11/2013 | Viner et al. | |
| 8,656,546 | B2 * | 2/2014 | Wang | A47K 7/026 4/606 |
| 9,084,514 | B1 * | 7/2015 | Elswick | A47K 7/026 |
| 9,095,373 | B2 * | 8/2015 | Guynn | A46B 5/0008 |
| D791,961 | S | 7/2017 | Song | |
| 10,292,568 | B1 * | 5/2019 | Ricks | A47L 23/22 |
| 10,617,264 | B1 * | 4/2020 | Sookdeo | A47K 7/03 |
| D949,370 | S | 4/2022 | Barzvi | |
| 11,369,190 | B2 * | 6/2022 | Chang | A46B 9/06 |
| 11,445,804 | B1 * | 9/2022 | Heacock | A46B 9/023 |
| 12,185,827 | B2 * | 1/2025 | Kim | A46B 15/0004 |
| 2020/0238549 | A1 * | 7/2020 | Abramsky | A45D 27/00 |
| 2020/0315407 | A1 * | 10/2020 | Kennedy | A45D 44/16 |

* cited by examiner

TOE CLEANING DEVICE

RELATED APPLICATIONS

Non-applicable.

FIELD OF THE INVENTION

The presently disclosed subject matter is directed to a personal hygiene device and more specifically to a toe cleaning device.

BACKGROUND OF THE INVENTION

As most people know, a good shower is a healthy way to keep the body clean and feel refreshed. When showering, most people make use of various cleaning implements e.g., a loofa, washcloth, back scrubber etc. While these implements facilitate an effective shower, they are not well suited to every part of the body.

While various parts of the body are relatively easy to clean and readily accessible—others are not. One particular region that presents some difficulty is cleaning of the toes. This is particularly difficult in a shower as it requires the user to bend over to reach between and around the toes. Furthermore, depending on the size of the person, the health of the person, and the size of the shower, bending over may not be an option. Accordingly, there exists a need for a means by which a person may clean his or her toes in a manner that avoids the aforementioned issues. The development of the toe cleaning device fulfills this need in a manner that is efficient and cost effective.

SUMMARY OF THE INVENTION

The present invention provides for a toe cleaning device which has a base having an upper surface and a lower surface, an attachment mechanism attached to the base, the attachment mechanism is configured to releasably attach the base to a surface, a plurality of base protrusions each having a scrubbing portion disposed on an upper end of each of the base protrusions, the base protrusions are attached to the base, and an extension integral with the base, the extension includes a plurality of extension protrusions.

The upper surface and the lower surface may be planar, and each include a sidewall. The attachment mechanism may be integral to the base. The lower surface of the base may include the attachment mechanism extending therefrom. The attachment mechanism may be a suction cup. The base protrusions may be integral to the base. The base protrusions may include a bottom end that is attached to the upper surface of the base.

The base protrusions may include the bottom end that is integral to the upper surface of the base. The base protrusions may have a frusto-conical shape that flares outward at the base scrubbing portion. The base scrubbing portion may include a planar upper surface, a slightly concave upper surface, or a slightly convex upper surface. The side walls of the base protrusion and the upper surface of the base scrubbing portion may be smooth.

The side walls of the base protrusion and the upper surface of the base scrubbing portion may be textured. The outer surfaces of the base protrusions and the base scrubbing portions may be configured to provide a way to enable a user to scrub portions of their toes thereupon. An elongated extension may be disposed on a center of the upper surface of the base and has a bottom end attached thereto or integral therewith and extends upward to terminate at an upper end. The elongated extension may extend a distance past the base scrubbing portions and includes an extension surface. The distance may be one to two inches. The elongated extension may be one-fifth of the diameter of the base and gently tapers inwards as it approaches a rounded terminal upper end.

The extension protrusions may each have an extension scrubbing portion attached to the extension surface and extend perpendicularly away therefrom. The extension protrusions and the extension scrubbing portion may have a frusto-conical shape that flares outward at the extension scrubbing portion. The toe cleaning device may be made of resilient, deformable, waterproof, and inert material.

BRIEF DESCRIPTION OF THE DRAWINGS

These and other features, aspects, and advantages of the present disclosure will become better understood with regard to the following description, appended claims, and accompanying drawings where:

DESCRIPTIVE KEY

Figure 1:
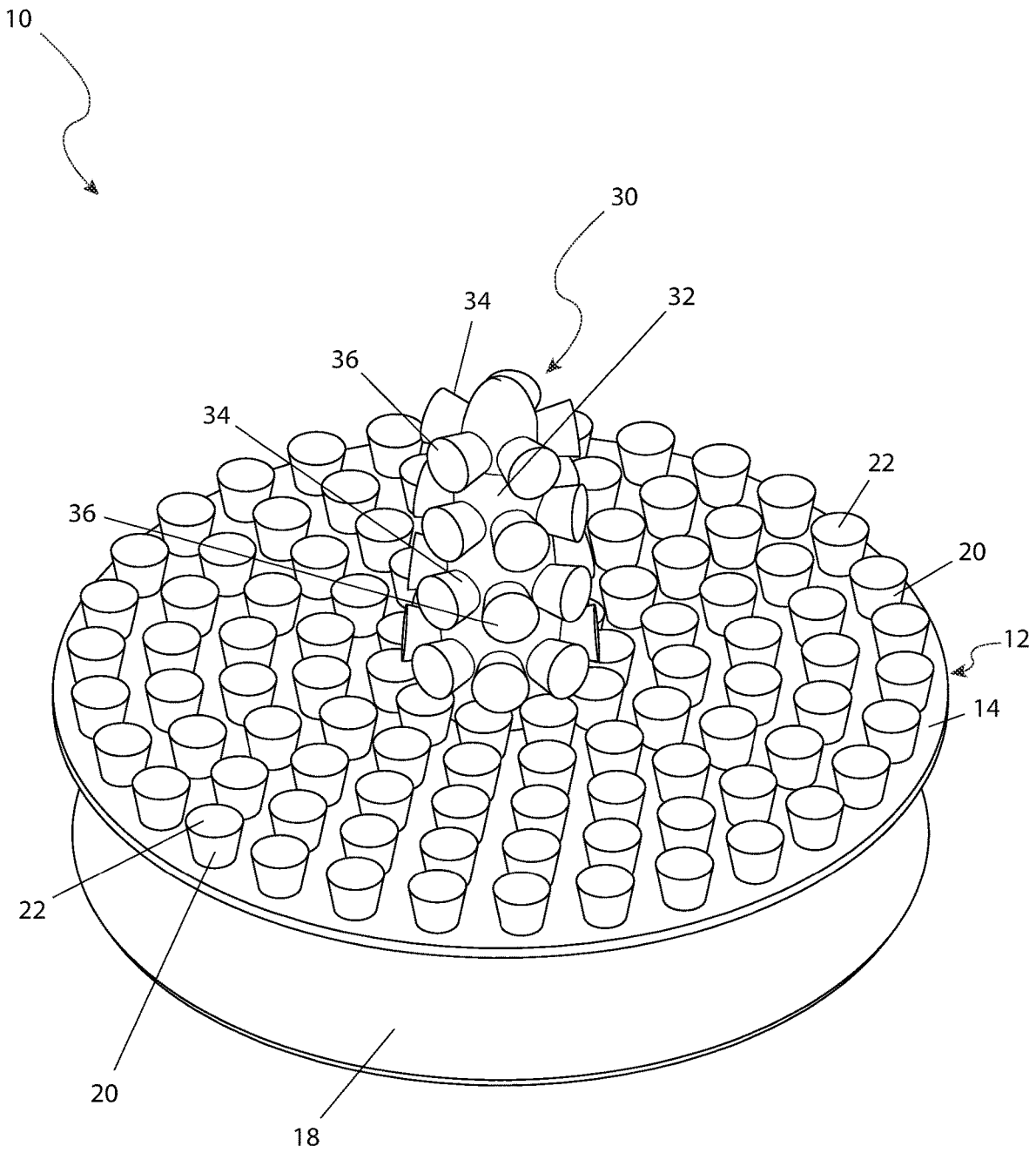
FIG. 1 is a perspective view of a toe cleaning device, according to an embodiment of this disclosure.

10 toe cleaning device
12 base
14 upper surface
16 lower surface
18 attachment mechanism
20 base protrusion
22 base scrubbing portion
30 extension
32 extension surface
34 extension protrusion
36 extension scrubbing portion

DETAILED DESCRIPTION

The following disclosure is provided to describe various embodiments of a device used for enabling a user to removably attach a toe cleaning device 10 to a support surface so as to provide a sturdy, resilient, and relatively immovable means capable of enabling a user to scrub their toes. The toe cleaning device 10 is particularly suited for removable attachment to a shower or bathtub floor surface, but other planar surfaces can be seen to fall under the overall scope of the present invention.

Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Various aspects of the present disclosure will now be described in detail, without limitation. Skilled readers should not view the inclusion of any alternative labels as limiting in any way. Referring now to FIGS. 1-7, an illustrative toe cleaning device will now be discussed in more detail.

FIG. 1 shows a toe cleaning device 10 configured to facilitate washing between toes of a user. The device 10 includes a base 12. The base 12 may include various shapes, for example, oval, oblong, triangular, rectangular, square, polygonal, irregular, uniform, non-uniform, variable, and/or tapered, however, in the exemplary embodiment, the base 12 is preferably circular in cross-section. The device 10 is preferably fabricated out of a resilient, deformable, waterproof, and inert material. An attachment mechanism 18 is attached or integral with the base 12. A plurality of base protrusions 20 are attached to or integral with the base 12. Also, an extension 30 is integral with the base 12, the extension 30 also having a plurality of extension protrusions 34.

Figure 2:
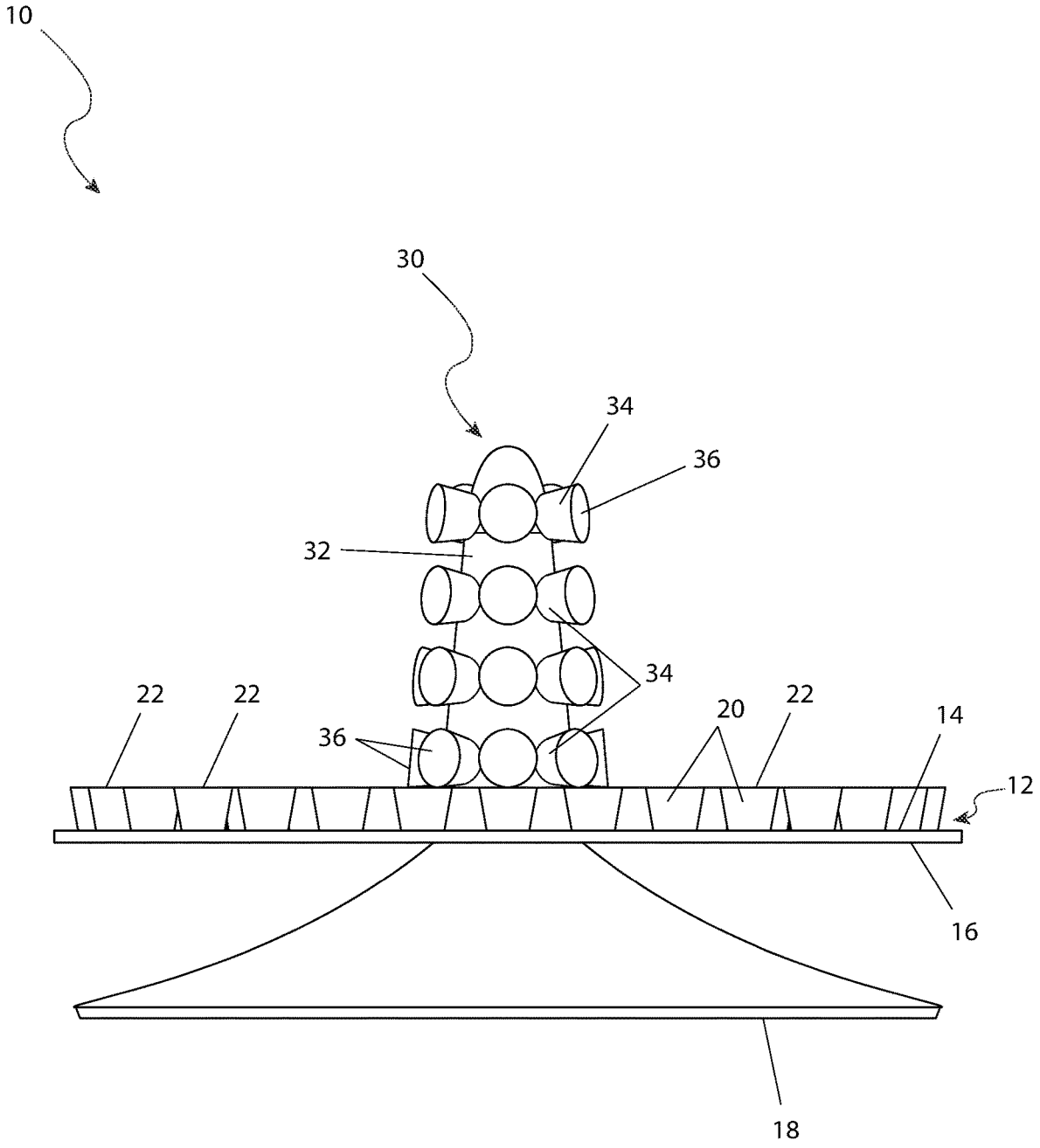
FIG. 2 is a side view of the toe cleaning device, according to an embodiment of this disclosure.
Figure 3:
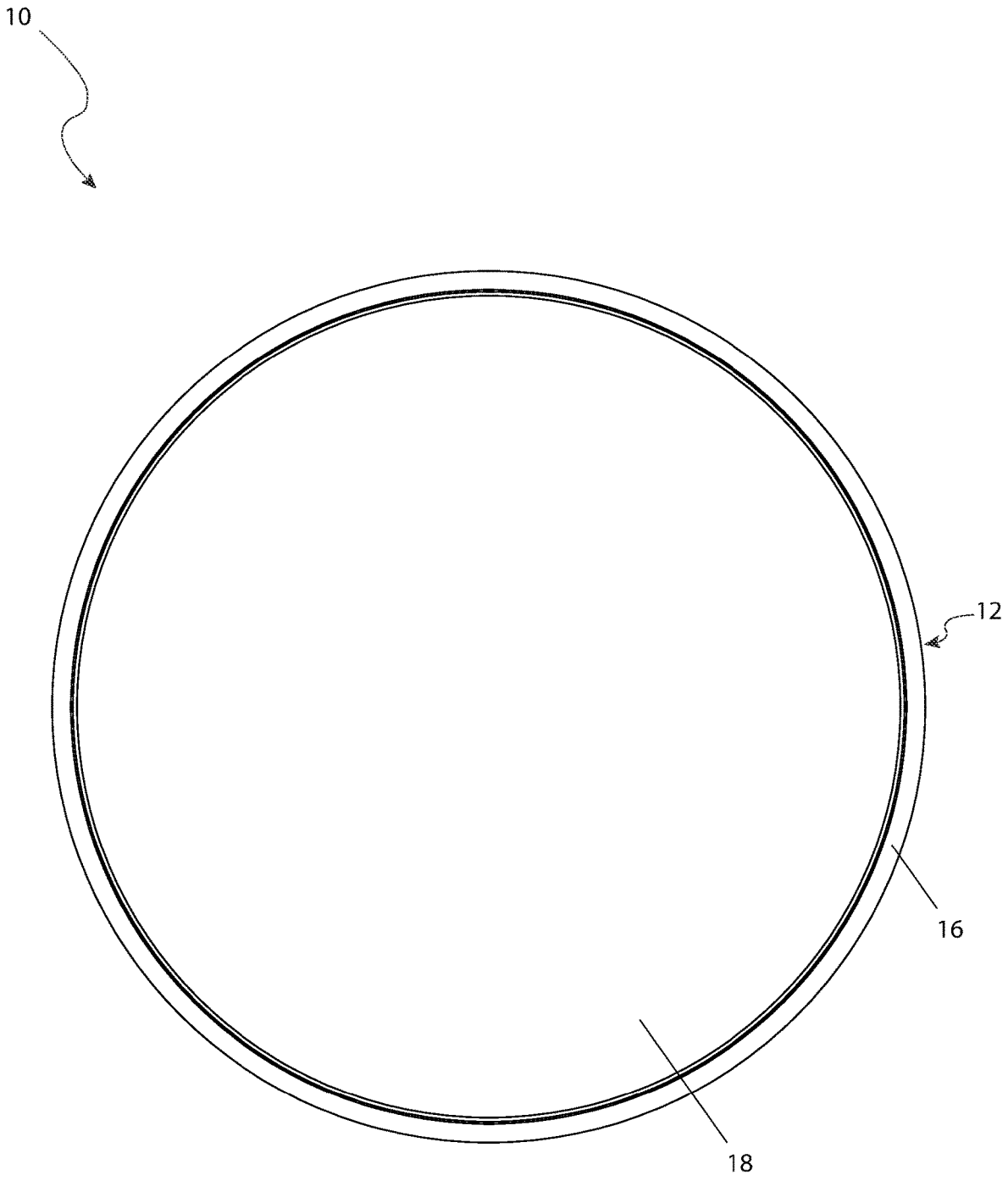
FIG. 3 is a bottom view of the toe cleaning device, according to an embodiment of this disclosure.

FIG. 2 shows the base 12 having an upper surface 14 and a lower surface 16. In some embodiments, the upper surface 14 and lower surface 16 are planar and there is a sidewall. The base 12 therefore is relatively disk-shaped. FIG. 3 shows the lower surface 16 having an attachment mechanism 18 extending therefrom. The attachment 145 mechanism 18 is configured to releasably attach the device 10 to a surface, for example, a bathtub or shower surface. As such, in a preferred embodiment, the attachment mechanism 18 is a suction cup.

Figure 4:
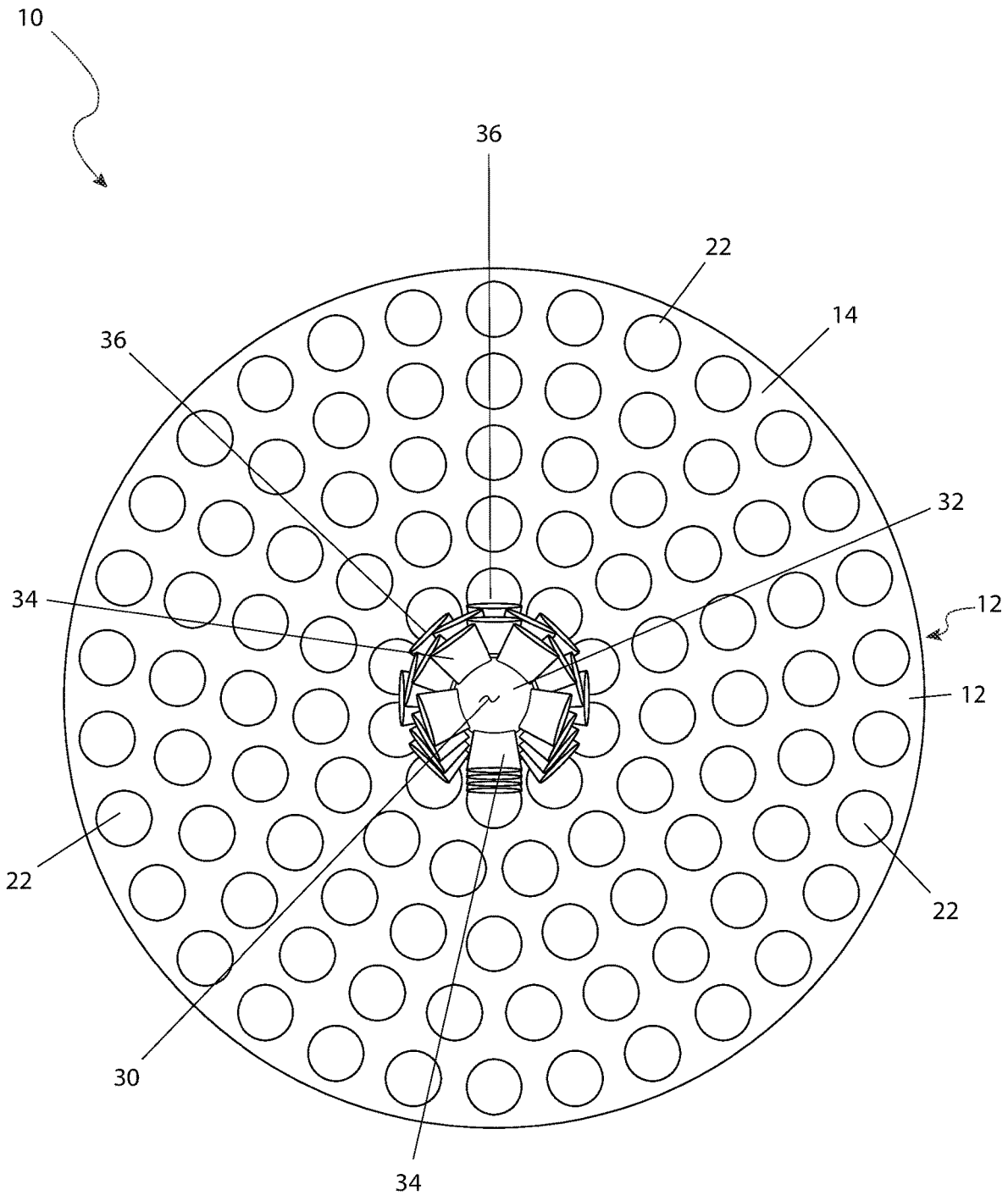
FIG. 4 is a top view of the toe cleaning device, according to an embodiment of this disclosure.

FIGS. 2 and 4 show the upper surface 14 disposed in orientation opposite to the lower surface 16. A plurality of base protrusions 20, each configured with a scrubbing portion 22, are attached to or integral with the upper surface 14 and extend vertically therefrom. The base protrusions 20 include a bottom end that is attached to or integral with the upper surface 14, and an upper end defined as the base scrubbing portion 22. In the exemplary embodiment, the overall shape of the base protrusions 20 and base scrubbing portion 2 is a frusto-conical shape that flares outward at the base scrubbing portion 22. The base scrubbing portion 22 may have a planar upper surface, a slightly concave upper surface, or a slightly convex upper surface. The side walls of the base protrusion 20, as well as the upper surface of the base scrubbing portion 22 may be smooth or have a texture. The outer surfaces of the base protrusions 20 and base scrubbing portions 22 are configured to provide a way to enable a user to scrub portions of their toes thereupon.

An elongated extension 30 is located at a center of the upper surface 14 of the base 12 and has a bottom end attached thereto or integral therewith and extends upward to terminate at an upper end. The extension 30 extends a distance past the base scrubbing portions 22 and includes an extension surface 32. Such a distance may be one to two inches (1-2 in.). The extension 30 may be approximately one-fifth (⅕) the diameter of the base 12 and gently taper inwards as it approaches the terminal upper end, at which it is rounded. The extension 30 may be solid or hollow.

A plurality of extension protrusions 34, each configured with an extension scrubbing portion 36, are attached to or integral with the extension surface 32 and extend perpendicularly away therefrom. The extension protrusions 34 include a first end that is attached to or integral with the extension surface 32, and a second end defined as the extension scrubbing portion 36. In the exemplary embodiment, the overall shape of the extension protrusions 34 and extension scrubbing portion 36 is a frusto-conical shape that flares outward at the extension scrubbing portion 36. The extension scrubbing portion 36 may have a planar outer surface, a slightly concave upper surface, or a slightly convex upper surface. The side walls of the extension protrusion 34, as well as the outer surface of the extension scrubbing portion 22 may be smooth or have a texture. The outer surfaces of the 180 extension protrusions 34 and extension scrubbing portions 36 are configured to provide a way to enable a user to scrub portions of their toes thereupon.

In some embodiments, the base protrusions 20, base scrubbing portion 22, extension protrusions 34, and extension scrubbing portions 36 may include a resilient, memory foam-type material such that as the foot is manipulated relative to the base protrusions 20, base scrubbing portions 22, extension protrusions 34, and extension scrubbing portions 36 move back and forth and return to their vertical orientation after cleaning is complete.

In an intended operation, a user may attach device 10 to a surface using the attachment mechanism 18. The user may motion their foot along device 10 such that the extension 30 moves in between toes and the extension scrubbing portions 36 scrubs and washes between the toes. The base scrubbing portions 22 are configured to scrub and wash along a bottom of the foot. Soap or lotion may be applied directly to the user's foot or toes, or directly on the device 10, to assist in providing a cleaning or hydrating effect to the foot and/or toes.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

The invention claimed is:

1. A toe cleaning device, comprising:

a base having an upper surface and a lower surface;

a suction cup affixed to or integral with the lower surface of the base, the suction cup being configured to releasably secure the base to a bathing surface;

a plurality of base protrusions extending upward from the upper surface of the base, each base protrusion having a lower end connected to the base and an upper end comprising a base scrubbing portion;

an elongated extension projecting vertically from a central region of the upper surface of the base, the elongated extension terminating at a rounded upper end and including an extension surface; and, a plurality of extension protrusions extending perpendicularly from the extension surface, each extension protrusion having a first end attached to the extension surface and a second end comprising an extension scrubbing portion; and, wherein the base scrubbing portions and the extension scrubbing portions each have a frusto-conical shape flaring outward at the upper end thereof and are formed of a resilient, deformable, waterproof, and inert material; and, wherein the base scrubbing portions are configured to scrub a bottom surface of a foot and the extension scrubbing portions are configured to clean between toes of a user when the device is affixed to a surface and the foot is manipulated thereon.

* * * * *